US006224049B1

(12) United States Patent
Hosking et al.

(10) Patent No.: US 6,224,049 B1
(45) Date of Patent: May 1, 2001

(54) SHEET FEED APPARATUS

(75) Inventors: Steven Michael Hosking; John Alan Skinner, both of Hants (GB)

(73) Assignee: De La Rue International Ltd., Basingstoke (GB)

( * ) Notice: Subject to any disclaimer, the term of this patent is extended or adjusted under 35 U.S.C. 154(b) by 0 days.

(21) Appl. No.: 09/269,551

(22) PCT Filed: Oct. 14, 1997

(86) PCT No.: PCT/GB97/02826

§ 371 Date: Mar. 30, 1999

§ 102(e) Date: Mar. 30, 1999

(87) PCT Pub. No.: WO98/23513

PCT Pub. Date: Jun. 4, 1998

(30) Foreign Application Priority Data

Nov. 27, 1996 (GB) ..... 9624631

(51) Int. Cl.[7] ..... B65H 5/00

(52) U.S. Cl. ..... 271/10.03; 271/10.08; 271/10.11; 271/121; 271/125; 271/35

(58) Field of Search ..... 271/10.03, 10.08, 271/10.11, 110, 121, 124, 125, 35

(56) References Cited

U.S. PATENT DOCUMENTS

| | | | | |
|---|---|---|---|---|
| 3,961,786 | * | 6/1976 | Yanker | 271/10.03 X |
| 4,651,982 | | 3/1987 | Martin . | |
| 5,172,899 | * | 12/1992 | Tajima | 271/125 X |
| 5,211,388 | * | 5/1993 | Walluk | 271/125 X |
| 5,362,037 | * | 11/1994 | van der Werff et al. | 271/125 X |
| 5,435,540 | | 7/1995 | Martin et al. . | |
| 5,443,359 | * | 8/1995 | Miller et al. | 271/125 X |
| 5,678,817 | * | 10/1997 | Saito et al. | 271/125 X |
| 5,876,029 | * | 3/1999 | Wright et al. | 271/10.03 X |

FOREIGN PATENT DOCUMENTS

| | | | |
|---|---|---|---|
| 196 05 106 A1 | | 8/1996 | (DE) . |
| 0 393 589 A1 | | 10/1990 | (EP) . |

* cited by examiner

*Primary Examiner*—David H. Bollinger
(74) *Attorney, Agent, or Firm*—Oliff & Berridge, PLC

(57) ABSTRACT

Sheet feed apparatus for supplying sheets such as banknotes from a store (1) to a sheet transport system. The apparatus comprises a feed system (4) for withdrawing sheets from the store (1). A separator system (12) is provided to which sheets are fed by the feed system (1), the separator system being adapted to feed sheets singly to the sheet transport system (22, 23). A controller (29) controls operation of the feed and separator systems (1, 12) independently.

19 Claims, 6 Drawing Sheets

SHEET FEED APPARATUS

BACKGROUND OF THE INVENTION

The invention relates to sheet feed apparatus for supplying sheets from a store to a sheet transport system and is applicable, for example, to the feeding of banknotes and other security documents.

DESCRIPTION OF RELATED ART

A well known approach, which is adopted in many banknote counters and sorters for feeding sheets from a store, employs a synchronous technique in which rollers with a high friction surface on part of their circumference are used to feed notes into a transport system at a fixed rate. The rollers are constantly rotating at a fixed speed and thus the picking action on the note is applied at a constant rate.

It is also known in some cases, as for example described in EP-A-0174200, to use an asynchronous technique using rollers having a high friction surface around their complete circumference. In this case, the speed of the rollers is modulated to provide control of the gap between the notes fed.

In most cases, it is usual to provide a separating mechanism forming part of the feed system to prevent more than one sheet from being fed into a sheet transport system which carries the sheets onto an outlet or other processing position. The separating mechanism is rotatably driven by the same motor driving the feed system to provide a linear speed to the sheet at the separating system essentially equal to that provided by the feed system.

An example of known sheet feeding apparatus is described in DE-A-19605106. In this case, a feed system is formed by a set of feed rollers, one or a number of which engage the topmost sheet in a stack to be fed. A contra-rotating roller is separately driven from the remainder of the feed system and acts in conjunction with the feed system to ensure that single sheets are fed on into a main transport system.

EP-A-0393589 illustrates a system for stream feeding sheets in an overlapped manner to a main transport system. In this case, sheets are withdrawn from a stack by a friction feed roller and fed to a downstream roller in the feed system, the downstream roller interacting with a separately driven roller to reduce the overlap between the sheets which are fed.

A major design consideration of each system is the range of sheet sizes which must be handled. This affects the distance between the first point of contact with the sheets of the feed system and the first pinch point of the sheet transport system. This distance must be less than the length (in the transporting direction) of the shortest sheet otherwise the sheet transport system will not pull the sheet clear of the store. Because of this, the first pinch point of the sheet transport system has to be mounted close to the sheet separation system with the result there is a tendency for sheets to be stream fed. This construction also causes space constraints on the height of the sheet store.

SUMMARY OF THE INVENTION

In accordance with a first aspect of the invention, a sheet feed apparatus for supplying sheets from a store to a sheet transport system comprises a feed system for withdrawing sheets from a store; a separator system, spaced from and independent of the feed system, to which sheets are fed by the feed system, the separator system being adapted to feed sheets singly to a sheet transport system, the separator system including a rotatable feed member for feeding sheets to the sheet transport system; and a control system for controlling operation of the feed system and the feed member of the separator system independently.

The invention is a new form of apparatus in which the feed system and separator system are completely independent of each other and independently operated, typically by separate motors. Thus, the feed system feeds sheets to the separator system, and the separator system feeds the sheets, independently of the feed system, to the transport system. In this way, the separator system becomes the main feeding element of the sheet feed apparatus. This allows the distance between the feed system and the sheet transport system to be extended. This should be contrasted with prior art arrangements in which separation is carried out by part of the feed system, sometimes in conjunction with a separately driven contra-rotating roller.

In some cases, the control system can stop rotation of the separator system for sufficient time, whilst the feed system is feeding a sheet, to enable the leading edge of an anticipated skew fed sheet to abut adjacent separator rollers of the separator system before the separator system is activated to transport on the essentially "straightened" sheet.

As has just been mentioned, two independent motors could be used to drive the feed and separator systems respectively although it would also be possible in some circumstances to use a single motor with suitable clutch and gear connections to the feed and separator systems. Furthermore, in some cases, the sheet transport system drive motor could also be used to drive the feed system.

The feed system could be driven either synchronously or asynchronously.

For example, the feed system could be activated in synchronism with, but a short time before, the separator system. Thus, the feed system will be designed to provide a fixed length feed shorter than the length (in the transporting direction) of the smallest sheet to be fed.

The feed system could be switched on and off at a fixed rate, each on period being less than that needed to feed the smallest sheet.

In a further example, the control system operates the feed system whereby sheets are fed in a continuous stream to the separator system which is then driven to control the feeding of separate individual sheets to the transport system.

Alternatively, the feed system may include at least one cyclically movable feed member part of whose surface defines a nudger portion, the control system continuously cyclically moving the feed member whereby sheets are only fed to the separator system when engaged by the nudger portion. With this approach, a series of synchronous nudges are provided to move the sheets against the separator system. The feed system could be defined by one or more rollers having relatively high friction inserts such as rubber inserts.

In an alternative approach, the apparatus further comprises a first sensor for sensing when the separator system receives a sheet from the feed system, the control system being responsive to the first sensor to deactivate the feed system when a sheet has been received by the separator system. This is an asynchronous mode of operation.

In all cases, sheets are fed in a non-overlapping manner, usually with a space between successive sheets.

Typically, the feed system will comprise one or more friction feed rollers or friction belts although other types of feed member such as vacuum belts or vacuum rollers could also be used.

The separator system may be implemented in a variety of ways. Preferably, however, the separator system acts as both the main feeding element of the apparatus and also as a gate to prevent additional sheets from being fed.

Typically, the apparatus further comprises a second sensor for sensing when a sheet is received by the sheet transport system, the control system being responsive to the output from the second sensor to cause the separator system to prevent further sheets being fed to the sheet transport system.

In one mode, the control system selectively stops the feed action of the separator system in order to ensure that only single sheets are fed to the sheet transport system. In an alternative mode, the control system selectively causes reverse operation of the separator system to ensure that only single sheets are fed to the sheet transport system. In this mode, modulating the motor current is used to vary the braking forces applied to the sheet.

In accordance with a second aspect of the present invention, a method of operating sheet feed apparatus according to the first aspect of the invention comprises repeatedly carrying out the following steps:

i) activating the feed system to withdraw a sheet from the store;

ii) after a predetermined interval, activating the separator system to feed a sheet from the feed system to the transport system; and iii) stopping or reversing the separator system when the sheet has been gripped to the transport system.

Preferably, during normal feeding, the separator system feeds sheets at substantially the same speed as the sheet transport system feed speed.

The main advantages of this invention are firstly that the maximum permissable distance between the point at which sheets are withdrawn from the store and the point at which they enter the sheet transport system is increased. The critical distance is now between the point at which sheets are received by the separator system and the point at which they are received by the sheet transport system. This is of benefit where physical limitations (such as overall height) constrain the design of the system. Secondly, aggressive separation should give a better performance, reducing the number of double sheets fed, reduce the skew of the notes fed into the transport and allow notes of different lengths to be present within the bundle of sheets to be fed.

The invention is applicable to a wide variety of sheet feed apparatus including sheet dispensers and sheet recirculators/counters where the invention can constitute a feed of the apparatus.

BRIEF DESCRIPTION OF THE DRAWINGS

Two examples of sheet feed apparatus according to the invention will now be described with reference to the accompanying drawings, in which.

DETAILED DESCRIPTION OF PREFERRED EMBODIMENTS

Figure 1A:
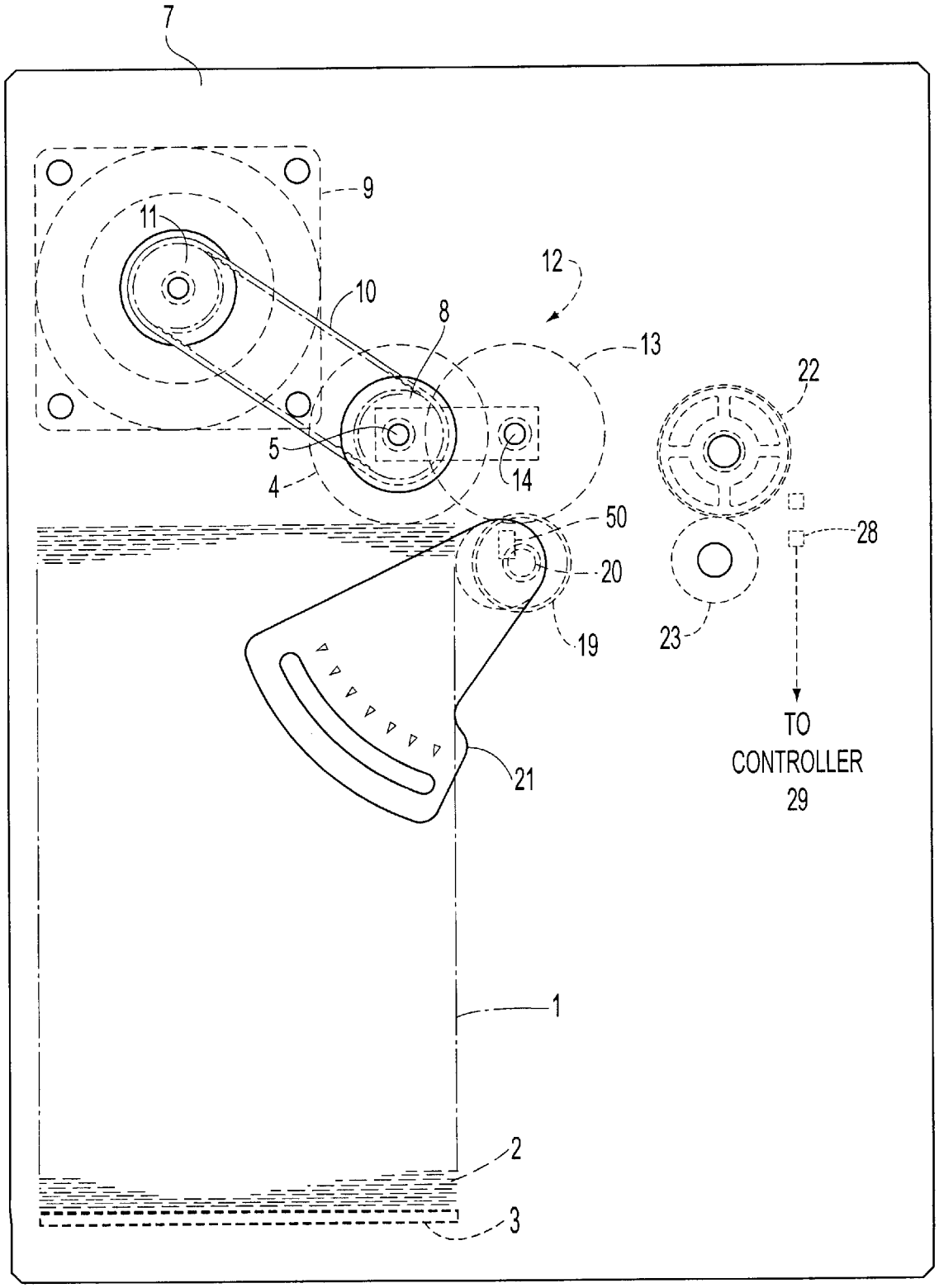
FIGS. 1*a* and 1*b* are schematic right and left side elevations respectively of a first example.

The apparatus shown in FIGS. 1*a,* 1*b* and 2 comprises a sheet store 1 containing a stack of sheets (usually of a common size) such as banknotes 2. The banknotes 2 are supported by a pressure plate 3 which is mounted to cause the sheet in the stack 2 furthest from the pressure plate to be urged against a pair of friction feed rollers 4 non-rotatably mounted on a shaft 5 journalled between a pair of side plates 6, 7. The shaft 5 carries a toothed pulley 8 non-rotatably mounted laterally outwardly of the side plate 7, the toothed pulley 8 being connected to a stepper drive motor 9 via toothed drive belt 10 and a further toothed pulley 11.

In this example, the feed rollers 4 have a continuous rubber surface around their circumference but in other examples, a high friction rubber insert extending only partly around the circumference could be used.

The topmost sheet from the stack 2 is fed upon rotation of the rollers 4 into a separator system 12 comprising a pair of separator rollers 13 non-rotatably mounted on a shaft 14 journalled between the side plates 6, 7. A toothed pulley 15 is non-rotatably mounted to the shaft 14 laterally outwardly of the side plate 6 and is connected by a drive belt 16 to a stepper motor 17 via a further toothed pulley 18. The rollers 13 also have a continuous rubber element around their circumference.

A set of contra-rotating rollers 19 are included within the separator system 12 and cooperate with the rollers 13 to prevent more than one sheet being fed through the separator system. The contra rollers 19 are mounted on a shaft 20 journalled between the side plates 6, 7 and are adjustable towards and away from the shaft 14 so as to adjust the gap between the rollers 13 and 19. The contra rollers 19 are step rotated in an anti-clockwise direction by a linkage system (not shown) in order to even out the wear that occurs on their circumferential surface. A scale 21 is provided to enable the position of the contra-rotating rollers 19 and hence the spacing between the rollers 13, 19 to be indicated.

Sheets are fed by the separator system 12 to the main sheet transport system whose entry pinch point is defined by a pair or pairs of rollers 22, 23 mounted on shafts 24, 25 respectively journalled between the side plates 6, 7. Each shaft 24, 25 carries non-rotatably a respective toothed pulley 26, 27 connected via drive belts (not shown) to a main drive motor (also not shown).

A sensor system 28 is provided for sensing when a sheet has been received by the sheet transport system, the sensor system 28 being connected to a controller 29.

In a first operation mode, the motor 9 is continuously driven so that the topmost sheet will be fed forward by the rollers 4 into the gap defined between the rollers 13, 19 of the separator system 12. The separator system 12 then frictionally drives the sheet towards the sheet transport system. The sensor 28 will indicate to the controller 29 when a sheet has been gripped by the sheet transport system and the controller 29 will continue to drive the separator rollers 13 via the motor 17 for a further distance which is dependent on the length in the feed direction of the sheets being fed since this reduces the drag from the trailing portion of the sheet. After this distance, the separator motor 17 is disabled without being decelerated. Separator drive motor 17 has a step-up gear ratio (such as 1:3) so that with the motor disabled the rollers 13 are free to turn while the sheet is being pulled across them by the sheet transport system. When the full sheet length has passed the separator rollers 13, power is supplied to the separator motor 17 but the motor is not pulsed or stepped. As a result, the rollers 13 are locked and provide a gate to prevent further sheets being pushed into the system by the feed rollers 4. Alternatively, the controller 29 could activate the motor 17 to turn the rollers 13 slowly in reverse. In this case, any sheets following behind the previous sheet are actively driven back out of the transport and sheets being pushed forward by the feed rollers 4 are prevented from going any further.

As has been mentioned above, other modes of operation are also possible. For example, the controller 29 could activate the rollers 4 by suitably controlling the motor 9 in synchronism with, but a short time before, the separator rollers 13. The rollers 4 would be designed to give a fixed rotation shorter than the length of the smallest length to be fed.

In another mode, the motor 9 could be switched on and off at a fixed rate, each on period being less than that required to feed the smallest sheet.

Figure 1B:
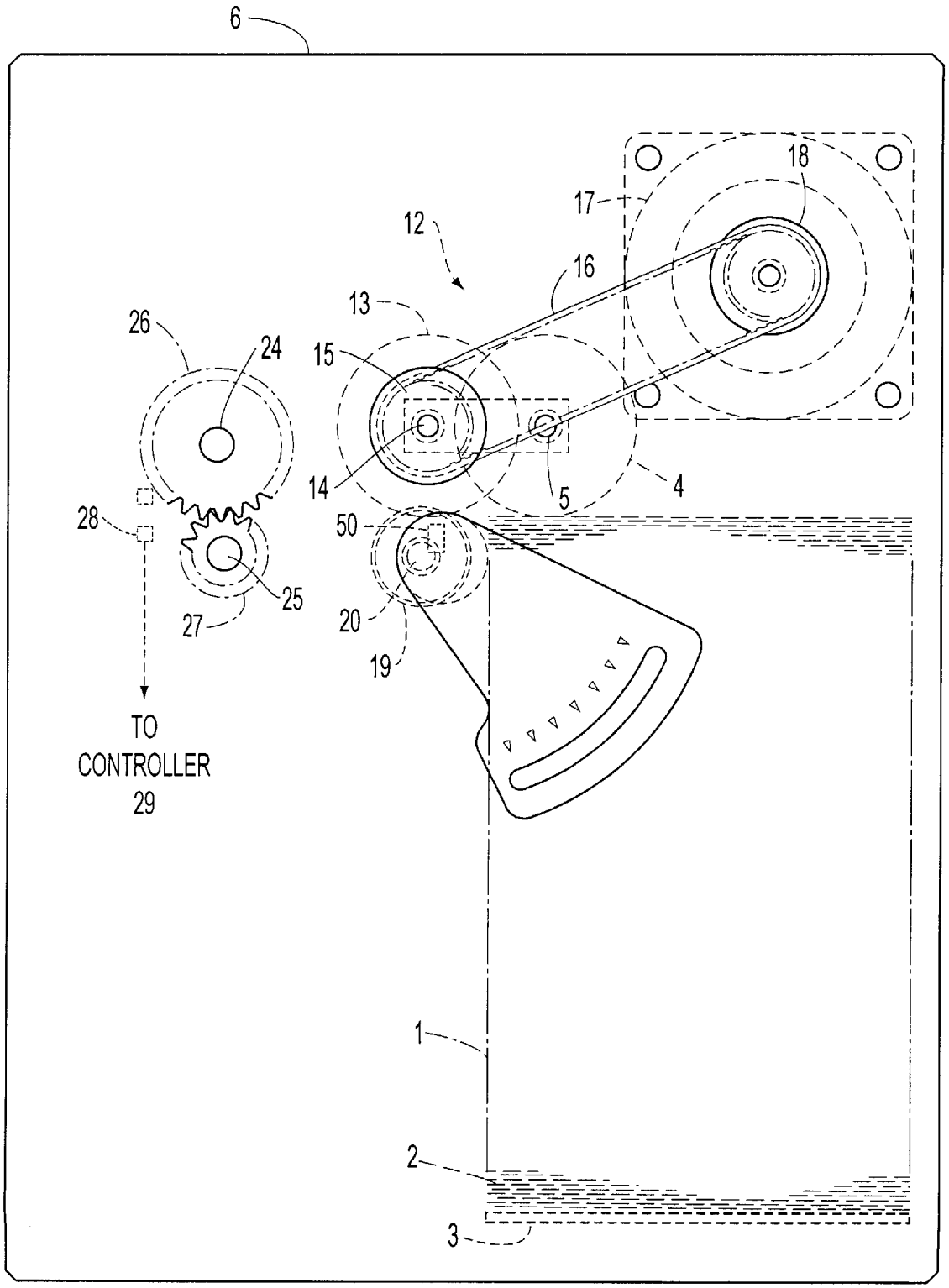
Figure 2:
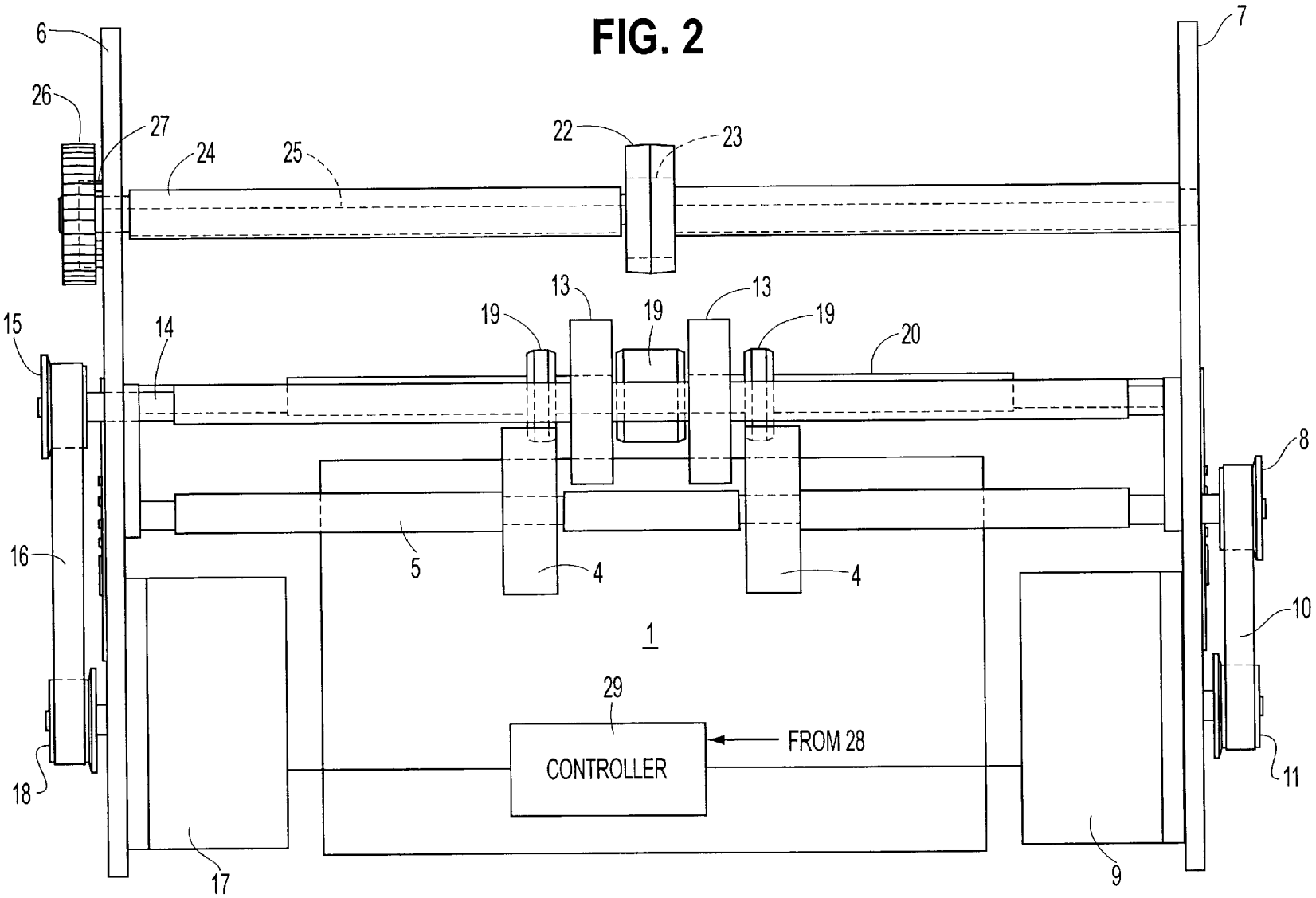
FIG. 2 is a plan of the apparatus shown in FIGS. 1*a* and 1*b;*

In a further example, an additional sensor 50 (shown in dashed lines in FIG. 1) could be provided adjacent the gap between the rollers 13, 19 and connected to the controller 29, the controller 29 responding to a signal from the additional sensor 50 indicating that a sheet has been received by the separator system 12 to stop the feed rollers 4.

As has been explained above, the advantage of this invention is that the critical distance between the gap defined by the rollers 13, 19 and that gap between the rollers 22, 23 must be less than the length of the shortest sheet to be fed. This should be contrasted with conventional systems in which the critical distance is that between the point at which the rollers 4 pick up a sheet from the stack and the pinch between the rollers 22, 23. The separator system 12 of the invention is used, in contrast to the prior art, to feed sheets to the transport independently of the feed system of feed rollers 4.

Figure 3:
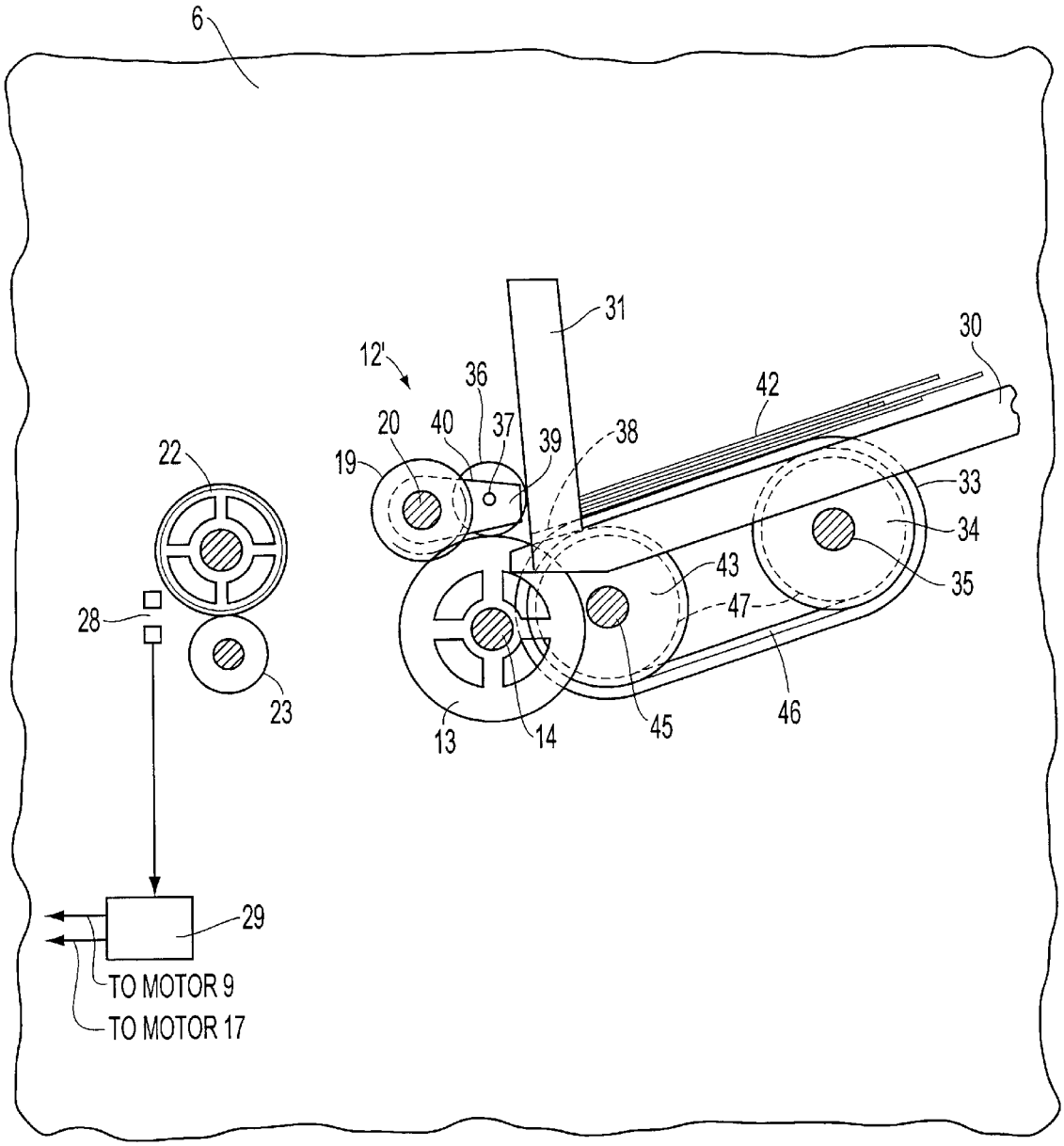
FIG. 3 is a schematic side elevation of a second example.
Figure 4:
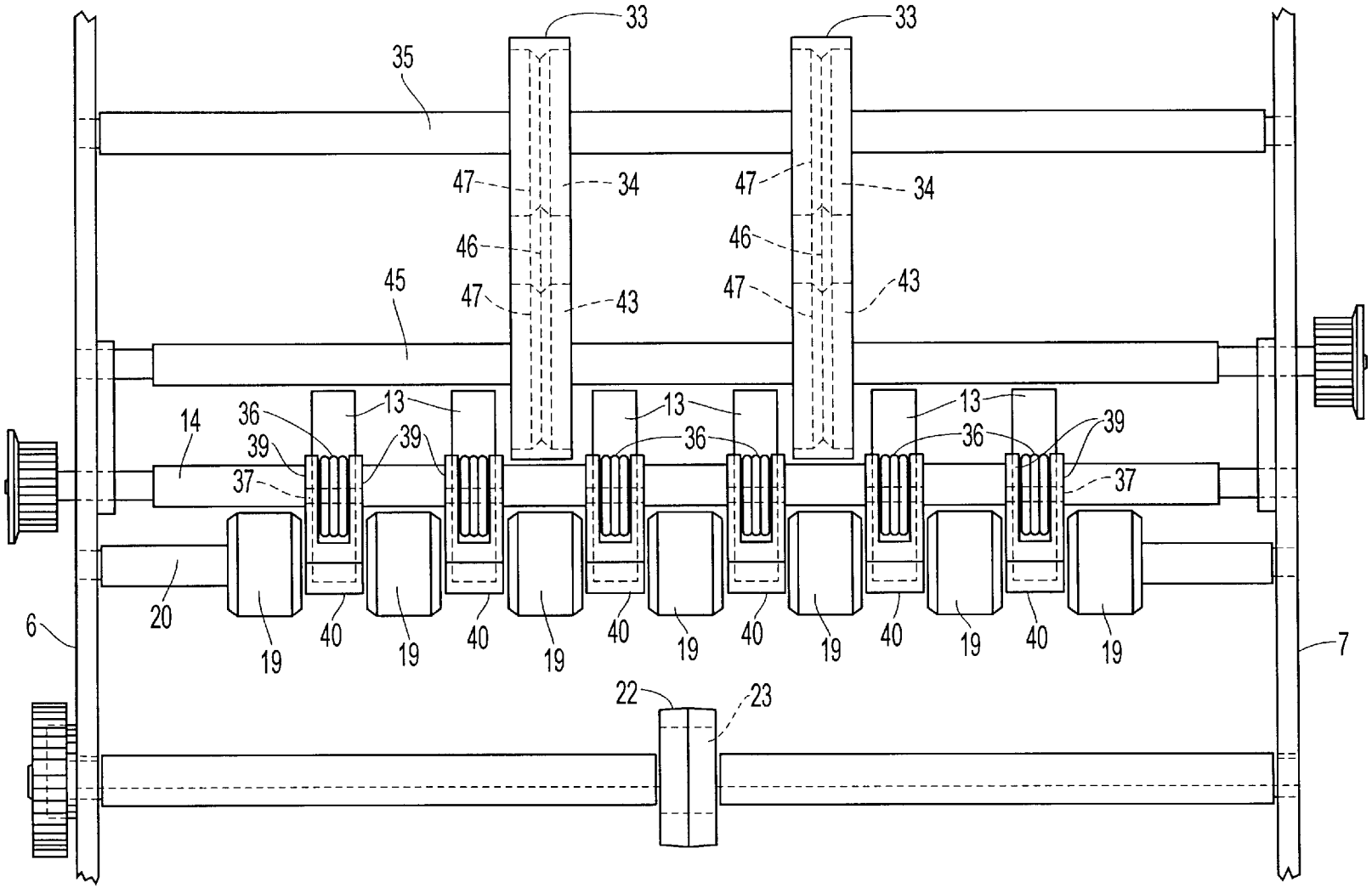
FIG. 4 is a plan, with some parts omitted, of the apparatus shown in FIG. 3; and, FIG. 5 is a flow diagram illustrating the preferred mode of operation of the second example.

A second example of the apparatus according to the invention is shown in FIGS. 3 and 4. This example is useful for handling a stack of sheets which are not necessarily of the same size. In this case, a stack of sheets 42 rests under the influence of gravity on a support plate 30 and on the upper frictional surface of a pair of laterally spaced belts 33. The belts 33 extend around pulleys 34 non-rotatably mounted to a shaft 35 which is journalled between the side plates 6, 7, and pulleys 43 which are non-rotatably mounted to a shaft 45 journalled between the side plates 6, 7. The shaft 45 is equivalent to the shaft 5 in the previous embodiment and is driven in a similar manner.

Each belt 33 has an inverted V-shaped flange 46 extending centrally along its inner surface, the flange 46 being received in corresponding grooves 47 in the pulleys 34, 43.

The leading edges of the sheets in the stack 42 abut a plate 31, there being a gap 38 between plates 30 and 31 through which the sheets are fed by the friction belts 33.

The apparatus shown in FIGS. 3 and 4 also includes a separator system 12' similar to the system 12 of the previous example but which includes, in addition, a set of six circumferentially grooved assist rollers 36 each of which is rotatably mounted to a pair of pins 37 extending laterally between a corresponding pair of arms 39 of a respective U-shaped support 40 pivoted to the shaft 20. The assist rollers 36 extend between pairs of the contra rollers 19 and define rotating guides to assist the leading edge of the fed sheet into the separating system 12'. The rollers 36 are rotated by their contact with the separator rollers 13.

Figure 5:
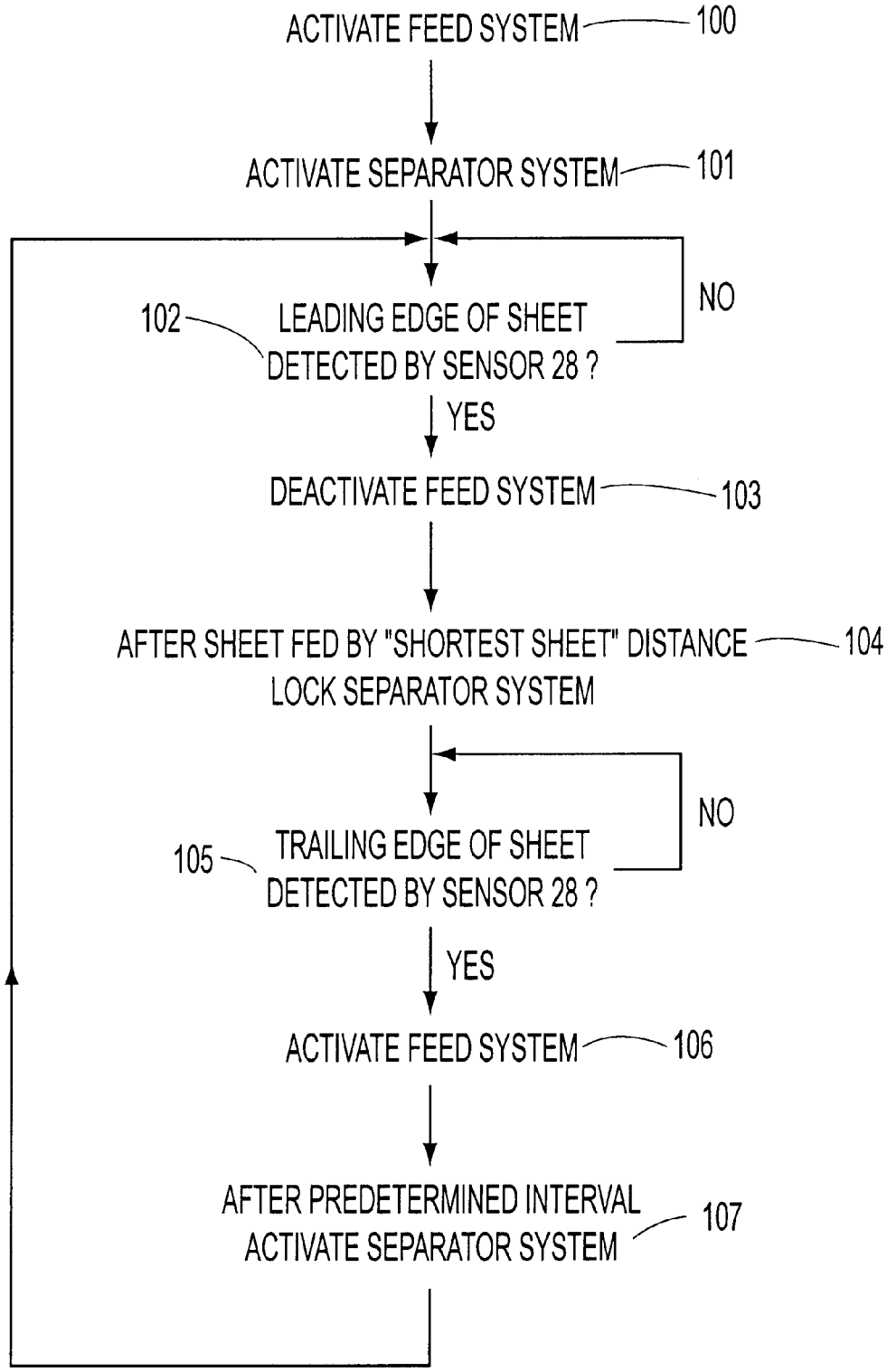

The preferred mode of operation is illustrated in FIG. 5. Initially (step 100) the motor 9 is activated causing the feed belts 33 of the feed system to be stepped in the feed direction and thus feed the bottom most sheet in the stack 42 towards the separator system 12'. At this stage, the separator system 12' is not operating and the bottom-most sheet is fed forward until it engages the separator rollers 13, 19 which are locked. This helps to de-skew the sheet. After a predetermined time interval which allows the sheet stack to settle, the controller 29 activates the motor 17 (step 101) which causes the separator rollers 13 to be stepped in their feed direction and the first sheet is drawn into the separator system and fed towards the rollers 22, 23 of the transport system. The leading edge of the sheet then enters into the nip between the rollers 22, 23 and shortly afterwards (for example a few millimetres) that leading edge will be sensed by the sensor 28 (step 102). (It will be appreciated that the sensor 28 has been shown significantly spaced from the nip between the rollers 22, 23 for clarity whereas in practice it will be much closer.) At this stage, the motor 9 is deactivated (step 103) to deactivate the feed system but the separator system continues to operate for a while to ensure that the sheet is fully gripped by the transport system. This is assumed to have occurred once the controller 29 determines that the separator system 12' has fed the sheet by a distance corresponding to the "shortest sheet" which is to be fed by the apparatus. Once the sheet has been fed by that shortest distance, the controller 29 locks the motor 17 so as to lock the rollers 13 of the separator system 12' (step 104). The transport system, which operates continuously, pulls the sheet through the nip between the rollers 22, 23 and thus out of the separator system 12'. Once the sensor 28 detects the passage of a trailing edge of the sheet (step 105), the controller 29 then reactivates the motor 9 (step 106) to push the next sheet against the separator rollers, deskewing the sheet. The motor 17 is reactivated after a predetermined gap to feed the next sheet to the transport system (step 107), and the cycle repeats. Of course, if no sheets are detected by the sensor 28 after a predetermined time period, the controller 29 will stop all the motors.

It should be understood that the first example could also be operated in accordance with FIG. 5.

In another mode of operation, the motor 9 is driven to rotate rollers 43 and belts 33 for a feeding time equivalent to the length of the shortest sheet in the stack 2 (or the sheet length if the stack 2 consists of sheets of the same length) whilst the drive to the separating system 12' is stopped. The bottom most sheet will be fed forward by the belts 33 into the gap defined between the rollers 13, 19 of the separator system 12'. At a time equivalent to the leading edge of the sheet moving from its initial position into the separator system roller gap plus a time provided to allow the leading edge of a skew fed sheet at both or each belt 33 position to enter the gaps between each of the roller 13, 19 pairs, motor 17 is operated to cause the separator system 12' to frictionally drive the sheet towards the sheet transport system (not shown) and the motor 9 is stopped. The sensor 28 will indicate to the controller 29 when the sheet has been gripped by the sheet transport system and the separating roller system 12' is stopped. When the trailing edge of the sheet being fed is detected by the sensor 28, a signal is sent to the controller 29 which then computes when the next sheet feeding cycle, commencing with the switching on of the motor 9, should be initiated.

An advantage of this second described implementation is that each sheet is aligned with the gap between the separator roller 13, 19 pairs before it is fed through the separator system whereas in traditional sheet feeders it has been necessary for the leading edges of the sheets to be aligned before initial feeding starts. This has not been practicable with stacks of sheets containing documents of different sizes.

The embodiment shown in FIGS. 3 and 4 is particularly useful for feeding sheets of different sizes in a single stack as, for example, may be found in banknote recirculators/counters.

In both embodiments, the separating system 12, 12' can be operated in reverse following receipt of a sheet by the sheet transport system to ensure only single sheets are fed to the sheet transport system.

What is claimed is:

1. A sheet feed apparatus for supplying sheets from a store to a sheet transport system, the apparatus comprising a feed system for withdrawing sheets from a store a separator system, spaced from and independent of the feed system, to which separator system sheets are fed by the feed system, the separator system being adapted to feed sheets singly to a sheet transport system, the separator system including a rotatable feed member for feeding sheets to the sheet transport system; and a control system for controlling operation of the feed system and the feed member of the separator system independently.

2. The apparatus according to claim 1, wherein the control system comprises two separate motors for driving the feed and separator systems respectively.

3. The apparatus according to claim 2, wherein the sheet transport system drive motor also drives the feed system.

4. The apparatus according to claim 1, wherein the control system actuates the feed system intermittently.

5. Apparatus according to claim 4, further comprising a first sensor for sensing when the separator system receives a sheet from the feed system, the control system being responsive to the first sensor to deactivate the feed system when a sheet has been received by the separator system.

6. The apparatus according to claim 1, wherein the feed system includes at least one cyclically movable feed member part of whose surface defines a nudger portion, the control system continuously cyclically moving the feed member whereby sheets are only fed to the separator system when engaged by the nudger portion.

7. The apparatus according to claim 1, wherein the control system operates the feed system continuously whereby sheets are fed in a continuous stream to the separator system.

8. The apparatus according to claim 1, wherein the feed system comprises one or more friction feed rollers or friction belts.

9. The apparatus according to claim 1, wherein the control system operates the separator system intermittently to ensure that only single sheets are fed to the sheet transport system.

10. The apparatus according to claim 9, further comprising a second sensor for sensing when a sheet is received by the sheet transport system, the control system being responsive to the output from the second sensor to cause the separator system to prevent further sheets being fed to the sheet transport system.

11. The apparatus according to claim 1, wherein the control system selectively stops the feed action of the separator system in order to ensure that only single sheets are fed to the sheet transport system.

12. The apparatus according to claim 1, wherein the control system selectively causes reverse operation of the separator system to ensure that only single sheets are fed to the sheet transport system.

13. A system according to claim 1, wherein during normal feeding, the separator system feeds sheets at substantially the same speed as the sheet transport system feed speed.

14. The apparatus according to claim 1, wherein the separator system comprises one or more friction feed rollers or friction belts.

15. Sheet dispensing apparatus comprising a sheet store; sheet feed apparatus according to claim 1 for withdrawing sheets from the store; and a sheet transport system for receiving sheets from the sheet feed apparatus and transporting them to a sheet outlet.

16. The sheet dispensing apparatus according to claim 15 for dispensing bank notes.

17. A method of operating a sheet feeding apparatus comprising a feed system for withdrawing sheets from a store, a separator system, spaced from and independent of the feed system separator system to which sheets are fed by the feed system, the separator system being adapted to feed sheets singly to a sheet transport system, the separator system including a rotatable feed member for feeding sheets to the sheet transport system, and a control system for controlling operation of the feed system and the feed member of the separator system independently, the method comprising repeatedly carrying out the following steps:

i) activating the feed system to withdraw a sheet from the store;

ii) after a predetermined interval, activating the separator system to feed a sheet from the feed system to the transport system; and iii) stopping or reversing the separator system when the sheet has been gripped by the transport system.

18. A method according to claim 17, wherein the feed system is stopped when a sheet has entered the transport system.

19. A method according to claim 17, wherein step iii) is performed after a sheet has been fed by the separator system for a distance equal to the length in the feed direction of the shortest sheet which is to be fed by the apparatus.

* * * * *